United States Patent [19]

Guzy et al.

[11] Patent Number: 4,658,089

[45] Date of Patent: Apr. 14, 1987

[54] ELECTRICAL CABLE WITH FABRIC LAYER

[75] Inventors: Raymond L. Guzy, Tulsa; Thomson H. Wallace, Claremore, both of Okla.

[73] Assignee: Hughes Tool Company, Houston, Tex.

[21] Appl. No.: 738,339

[22] Filed: May 28, 1985

[51] Int. Cl.[4] ..... H01B 7/18; H01B 7/02

[52] U.S. Cl. ..... 174/113 R; 156/54; 156/56; 174/116; 174/121 R; 174/121 AR

[58] Field of Search ..... 174/102 R, 113 R, 121 R, 174/121 AR, 116; 156/53, 54, 55, 56

[56] References Cited

U.S. PATENT DOCUMENTS

| | | | |
|---|---|---|---|
| 2,000,095 | 5/1935 | Pitman | 174/121 B |
| 2,007,761 | 7/1935 | Kaimer | 174/121 A |
| 2,718,544 | 9/1955 | Shepp | 174/113 R |
| 2,930,837 | 3/1960 | Thompson | 174/121 R |
| 2,936,258 | 5/1960 | Benton, Jr. | 174/121 R |
| 3,299,202 | 1/1967 | Brown | 174/121 R |
| 3,303,270 | 2/1967 | Shelton, Jr. | 174/121 R |
| 3,407,263 | 10/1968 | Miller | 174/113 R |
| 3,742,363 | 6/1973 | Carle | 174/121 R X |
| 3,832,481 | 8/1974 | Boyd et al. | 174/102 R |
| 3,889,049 | 6/1975 | Legg et al. | 174/113 R X |
| 3,909,467 | 9/1975 | Tatum | 260/8 |
| 4,088,830 | 5/1978 | Wargin et al. | 174/113 R |
| 4,096,351 | 6/1978 | Wargin et al. | 174/102 R |
| 4,284,841 | 8/1981 | Tijunelis et al. | 174/102 R X |
| 4,472,598 | 9/1984 | Boyd et al. | 174/113 R |

*Primary Examiner*—Arthur T. Grimley
*Assistant Examiner*—Morris H. Nimmo
*Attorney, Agent, or Firm*—James E. Bradley

[57] ABSTRACT

An electrical cable for a submersible well pump has an internal fabric layer for providing additional hoop strength. The cable has a plurality of conductors. Each conductor is surrounded by an insulating layer that is permeable to gas. A woven fabric layer surrounds each insulating layer. An elastomeric jacket is extruded over and preferably bonded to each fabric layer. The jacket has flocked fibers to allow gas desorption while pulling the cable to the surface.

2 Claims, 6 Drawing Figures

ELECTRICAL CABLE WITH FABRIC LAYER

BACKGROUND OF THE INVENTION

1. Field of the Invention

This invention relates in general to electrical cable, and in particular to an electrical cable for use with submersible pumps.

2. Description of the Prior Art

This invention concerns an electrical power cable used to power a downhole electrical motor for a submersible pump. These submersible pumps normally pump a mixture of oil and brine from wells often several thousand feet deep and often under high temperatures. The electrical cable normally consists of three stranded or solid conductors. Each stranded or solid conductor contains an insulating layer of a material that is resistant to oil and brine. Typically, in a round configuration, an elastomeric jacket is extruded over all three conductors and an outer metallic armor surrounds the jacket. For flat configuration cable, individually insulated and jacketed conductors are taped and braided prior to armoring in a flat configuration.

In wells that have a significant gas content, gas permeation of the jacket occurs by way of absorption which is accelerated by heat and pressure. Periodically, all submersible pumps must be pulled to the surface for servicing. As the pump is pulled to the surface, the pressure and temperature both rapidly decrease. If gas has permeated the jacket, the reduction in temperature and pressure traps low molecular weight gasses in the cable. The basically, non-porous impermeable jacket does not allow the gas to escape rapidly. The gas within expands under reduced pressure, causing the jacket to balloon, and rupture.

Improved cables are disclosed in U.S. Pat. Nos. 4,088,830 issued May 9, 1978 and U.S. Pat. No. 4,096,351, issued June 20, 1978, the inventors of both of which are Robert V. Wargin and Clinton A. Boyd. These patents teach the use of an insulating layer of thermosetting material that is resistant to oil and brine, but does allow some absorption of gas. The insulating material is relatively thin and allows gas to rapidly desorb when the cable is being pulled to the surface. A fiber braid surrounds each conductor, and contains the porous insulation layer to prevent rupturing of the insulation layer during depressurization. In the '351 patent, the conductors are surrounded by metallic armor, and in the '830 patent, the conductors are surrounded by a polypropylene, perforated layer, which serves as the armor. While the cables of these two patents perform successfully, the braid surrounding each conductor individually adds considerably to the cost of the cable.

In U.S. Pat. No. 4,472,598, Sept. 18, 1984, Clinton A. Boyd and Raymond L. Guzy, the braid is omitted, and the jacket surrounding the insulated conductors is perforated to allow gas to be released during depressurization.

In U.S. Pat. No. 3,909,467, Sept. 30, 1975, John A. Tatum, the jacket surrounding the insulated conductors contains randomly oriented flocked fibers of a non-thermoplastic material. These fibers allow the jacket to release gas absorbed therein upon depressurization. However, the jacket may not have sufficient hoop strength to prevent the insulating layer from rupturing during depressurization. This might particularly be a problem in flat cable where the jacket is of smaller diameter than in round cable.

SUMMARY OF THE INVENTION

In this invention, the cable has conductors surrounded by an insulating layer. A woven, fabric is helically wrapped or folded circumferentially around the insulating layer after the insulating layer has cured sufficiently so that the fabric layer will not bond to the insulating layer. A jacket is then extruded over the insulating layer and fabric layer, bonding to the fabric. The fabric layer adds strength to the jacket, allows gas permeability, and serves to prevent rupturing of the insulating layer.

DESCRIPTION OF THE PREFERRED EMBODIMENT

Figure 1:
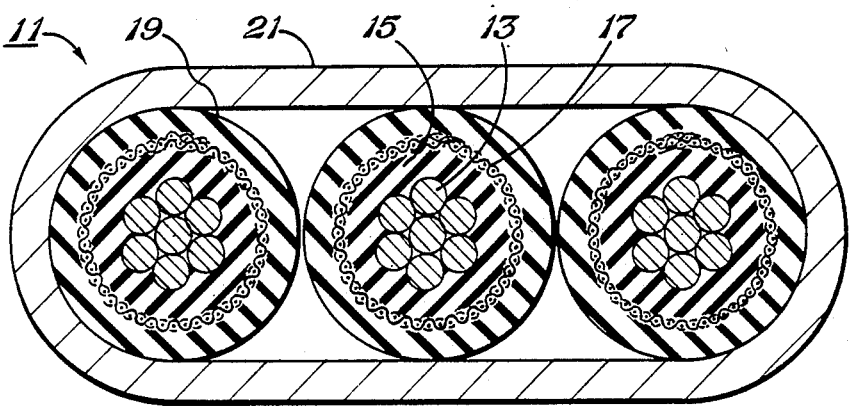
FIG. 1 is a cross-sectional view of a flat cable constructed in accordance with this invention.
Figure 3:
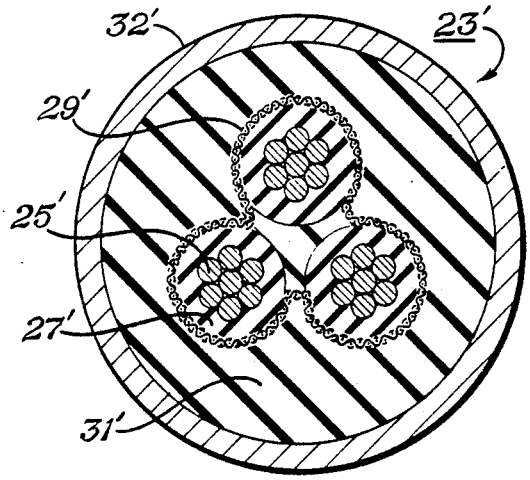
FIG. 3 is a cross-sectional view of a second embodiment of a round cable constructed in accordance with this invention.

Referring to FIGS. 1 and 3, electrical cable 11 contains three metallic, electrical conductors 13. Each of the conductors 13 is stranded, containing seven, wound strands of wire. An insulating layer 15 is extruded over each of the conductors 13. The conductors 13 are located side-by-side in the same plane and spaced apart from each other in FIG. 1.

Insulating layer 15 is of a type that is disclosed in U.S. Pat. Nos. 4,096,351, 4,088,830 and 4,472,598. It is oil and brine resistant and is permeable to low molecular gasses. Insulating layer 15 is relatively thin, having a thickness in the range from 0.020 to 0.150 inch, preferably between 0.070 and 0.110 inch. The thinness allows gas absorbed in the insulating layer 15 to rapidly desorb when the cable 11 is being pulled to the surface. The physical and electrical properties of the insulating layer 15 must remain essentially unaffected by the absorption of very low molecular weight hydrocarbons such as methane under high pressure. One material suitable for insulating layer 15 is a modified EPDM (ethylene-propylene-diene monomer terpolymer) blend such as disclosed in U.S. Pat. No. 3,926,900. The insulating layer 15 is extruded onto the conductors 13 and cured in place to provide an insulation layer resistant to attack by water and well fluids.

A fabric layer 17 surrounds each insulating layer 15. Fabric layer 17 is a woven cloth that is wrapped or wound around the insulating layer 15 after the insulating layer 15 has cured sufficiently so that no bonding will take place. Fabric layer 17 may be of various organic materials and is preferably nylon. The fabric layer is approximately 0.005 inch thick in the preferred embodiment.

Figure 4:
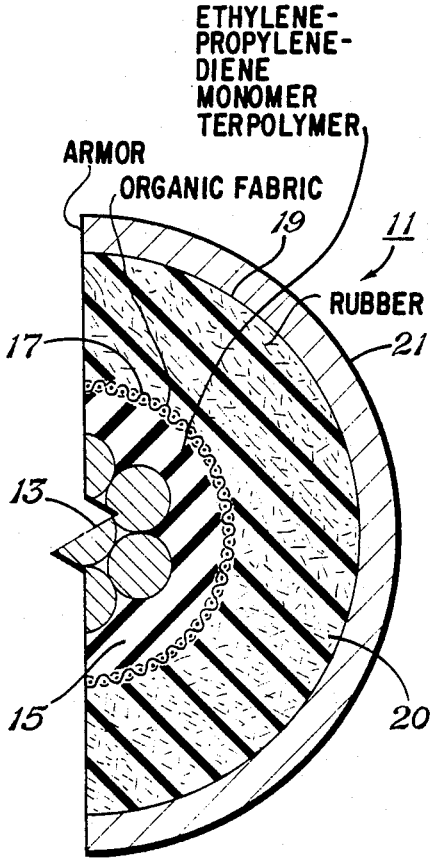
FIG. 4 is an enlarged cross-sectional view of a portion of the flat cable of FIG. 1.

A jacket 19 is extruded over and bonded to the fabric layer 17 of each conductor 13. Jacket 19 is approximately 0.050 to 0.090 inch thick. The material for jacket 19 can be any type of polymer, rubber or plastic suitable for downhole applications. This material should be resistant to attack or deterioration by chemical agents, including salts, acids, gasses and hydrocarbons present in the well. Preferably, the material of jacket 19 is an ethylene/acrylic elastomer blended with a polybutadiene as described in U.S. Pat. No. 4,472,598, all of which material is hereby incorporated by reference. Also, as shown in FIG. 4, jacket 19 preferably contains uniformly distributed randomly oriented flocked fibers 20. Fibers 20 are of nonthermoplastic material, preferably cellulose, and have lengths of about 1.5 millimeters. Fibers 20 comprise of approximately 10–15% by weight of the jacket 19.

In the embodiment of FIG. 1, three of the insulated and jacketed conductors 13 are aligned side-by-side and enclosed by a metallic armor 21. Armor 21 comprises metal strips that are wrapped about the cable for protection and strength.

In the operation of the embodiment of FIGS. 1 and 4, the cable 11 will be installed and used in a conventional manner. Well fluids will freely flow through the armor 21 into contact with the jackets 19. Gas under pressure in the well will be absorbed into the jackets 19 and into the insulating layers 15. Some of the gas may enter the area between the strands of the conductors 13. Jacket 19, however, will prevent any liquids, such as brine or oil from penetrating to the fabric layer 17 or into contact with the insulating layers 15.

If the ambient pressure surrounding the cable quickly reduces, the gas absorbed in the insulating layers 15 and jackets 19 must be desorbed to avoid rupturing and ballooning of the cable. A rapid drop in pressure occurs when pulling the cable to the surface for maintenance to the pump. The fibers 20 in the jacket 19 allow the gas to quickly desorb from the jacket 19. The gas also is released from the insulating layers 15 because of their thinness. The fabric layers 17 will not serve as a barrier against any of the gas. The fabric layers 17 add hoop strength to the jackets 19 to prevent rupturing of the insulating layers 15 as the cable 11 undergoes rapid depressurization.

Figure 2:
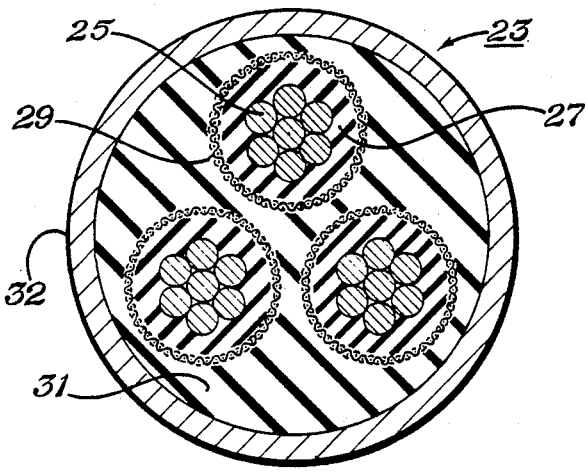
FIG. 2 is a sectional view of a round cable constructed in accordance with this invention.

The embodiment shown in FIG. 2 is constructed in the same manner as the embodiment of FIG. 1, however, it is in the form of a cylindrical or circular cross-section, rather than the flattened cross-section used in FIG. 1. Cable 23 has three conductors 25 radially spaced 120 degrees apart about the axis of cable 23. Each conductor 25 has an insulating layer 27 identical to the insulating layer 15 of FIG. 1. A fabric layer 29 surrounds each of the insulating layers 27 in the same manner as the embodiment in FIG. 1. A polymeric jacket 31, having material identical to jacket 19 is extruded over and around each of the conductors 25 in direct physical contact with the fabric layers 29. Metallic armor 32 surrounds the jacket 31.

In the embodiment of FIG. 3, the configurations are the same, except for the insulating layer 27. Prime symbols will be used to indicate the similar components. The conductors 25' are oriented 120 degrees apart. Each conductor 25' is surrounded by an insulating layer 27'. The fabric layer 29' is wrapped around all three of the insulating layers 27', however. The jacket 31' surrounds all three. During extrusion, material of the jacket 31' will flow through the strips of fabric layer 29' to enter the spaces between the three insulating layers 27'. Armor 32' surrounds the jacket 31'.

Figure 5:
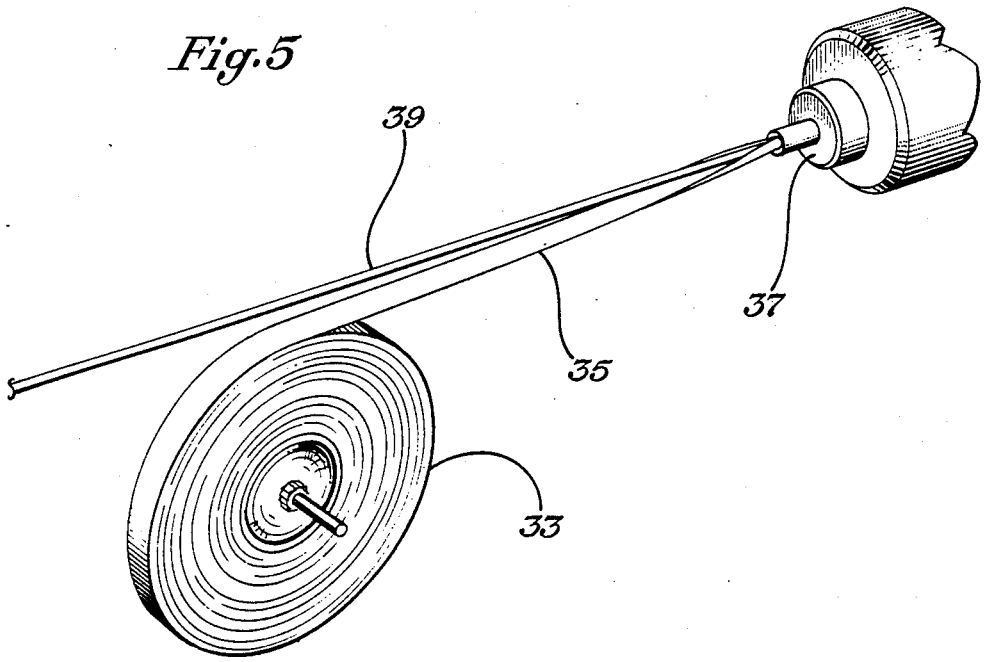
FIG. 5 is a perspective view showing one technique for wrapping the fabric around the cable in accordance with this invention.

FIG. 5 illustrates a method for wrapping the insulated cable with the fabric layers. A roll 33 of fabric has a strip 35 of fabric drawn from it. The fabric strip 35 is initially secured to the end of the insulated cable 39. Both the insulated cable 39 and the strip 35 are pulled through an extrusion die 37. In the extrusion die 37, the strip 35 folds over the cable 39. Strip 35 will be drawn through parallel with the cable 39, making a longitudinal fold. The fold line (not shown) will be parallel with the axis of the cable 39. In the extrusion die 37, the jacket is extruded around the fabric strip 35 to bond to the fabric strip 35. The cable 39 will have its insulating layer 15 (FIG. 1) sufficiently cured so that no bonding will take place between the fabric strip 35 and the cable 39. This allows the fabric strip 35 to be easily stripped back from the cable 39 for splicing.

Figure 6:
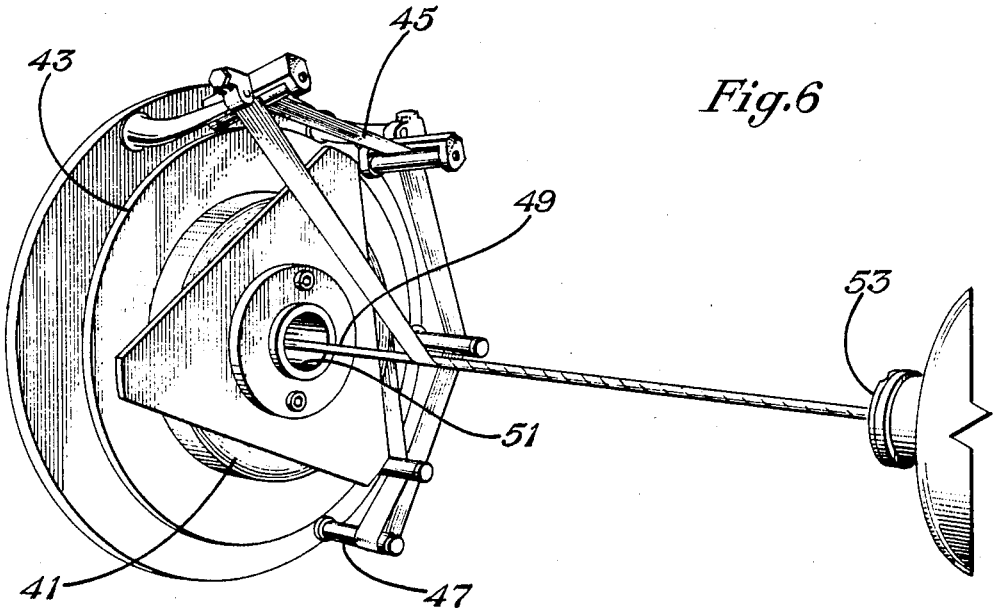
FIG. 6 shows another method of wrapping the cable with the fabric in accordance with this invention.

In FIG. 6, the fabric layer is wound or wrapped around the cable in a helical fashion. A fabric roll 41 is mounted to a rotating drum 43. A strip 45 from the fabric roll 41 is pulled past guide bars 47 and wrapped around the insulated cable 49, which is not rotating. The cable 49 extends through an opening 51 in the drum 43. The cable 49 is pulled axially forward as it is helically wrapped with the strip 45. The cable 49 is drawn through a die 53, where the jacket is extruded around the fabric strip 45.

The invention has significant advantages. The fabric on the inside diameter of the jacket provides added strength to prevent rupturing of the insulating layer. The added strength allows the jacket to be of high modulus and breathable for absorbing and desorbing gas. The fabric is protected from the downhole environment by the jacket. The fabric easily separates the jacket from the insulation to facilitate stripping of the cable during splice preparation.

While the invention has been shown in only a few of its forms, it should be apparent to those skilled in the art that it is not so limited but is susceptible to various changes without departing from the scope of the invention.

We claim:

1. An electrical cable for a submersible well pump, comprising in combination:

a plurality of conductors;

an insulating layer surrounding each conductor, the insulating layer being permeable to gas and resistant to oil and brine;

a separate woven fabric layer for each of the conductors, each fabric layer consisting essentially of organic material and individually surrounding each of the insulating layers in nonadhering contact; and a separate elastomeric jacket for each of the conductors, each jacket extruded over and bonded to the fabric layer, the fabric layers being of a sufficiently dense weave to prevent contact of the material of the jacket with the insulating layers during extrusion to facilitate stripping, the jacket having means for allowing gas absorbed in the insulating layers and the jacket to escape while the ambient pressure is lowered, the fabric layers providing hoop strength for preventing rupturing of the insulating layers.

2. A method of manufacturing an electrical cable for use with submersible well pumps, comprising in combination extruding an insulating layer around a conductor;

placing a strip of woven fabric layer consisting essentially of organic material longitudinally over the insulating layer after the insulating layer has cured sufficiently to prevent bonding with the fabric layer; then feeding the strip and the insulated conductor into an extruder, causing the fabric layer to fold longitudinally around the insulated conductor, and extruding an elastomeric jacket over the fabric layer, the jacket having means for allowing gas absorbed in the insulating layer and jacket to be released while lowering ambient pressure, the fabric layer providing additional hoop strength to prevent rupturing of the insulating layer.

* * * * *